United States Patent [19]

Gämmerler

[11] Patent Number: 4,633,746

[45] Date of Patent: Jan. 6, 1987

[54] DEVICE FOR PUNCHING FLAT SHAPED ARTICLES, PARTICULARLY PAPER, PAPERBOARD OR THE LIKE

[76] Inventor: Hagen Gämmerler, Ichoring 44, D-8021 Icking, Fed. Rep. of Germany

[21] Appl. No.: 724,620

[22] Filed: Apr. 18, 1985

[30] Foreign Application Priority Data

Apr. 18, 1984 [DE] Fed. Rep. of Germany ..... 3414783

[51] Int. Cl.[4] ..... B26D 5/16

[52] U.S. Cl. ..... 83/602; 74/437; 83/604; 100/293

[58] Field of Search ..... 83/601, 605, 628, 629, 83/630, 684; 74/25, 437; 100/281, 282, 293

[56] References Cited

U.S. PATENT DOCUMENTS

| | | | |
|---|---|---|---|
| 2,507,556 | 5/1950 | Bobst | 83/630 |
| 2,933,940 | 4/1960 | Hallden | 74/437 |
| 2,989,229 | 6/1961 | Barbean | 74/25 |
| 3,286,566 | 11/1966 | Griesinger | 83/630 |
| 4,459,887 | 7/1984 | Ingham | 83/311 |

*Primary Examiner*—Frank T. Yost
*Assistant Examiner*—Hien H. Phan
*Attorney, Agent, or Firm*—Paul L. Sjoquist

[57] ABSTRACT

In a device for punching flat shaped articles by means of a punching tool, which consists of two separate parts, an electromotor, a driving mechanism and a gearing, there are combined the electromotor, the gearing, the driving mechanism and one part of the punching tool to form a separately transportable constructional unit.

9 Claims, 3 Drawing Figures

Figure 1:
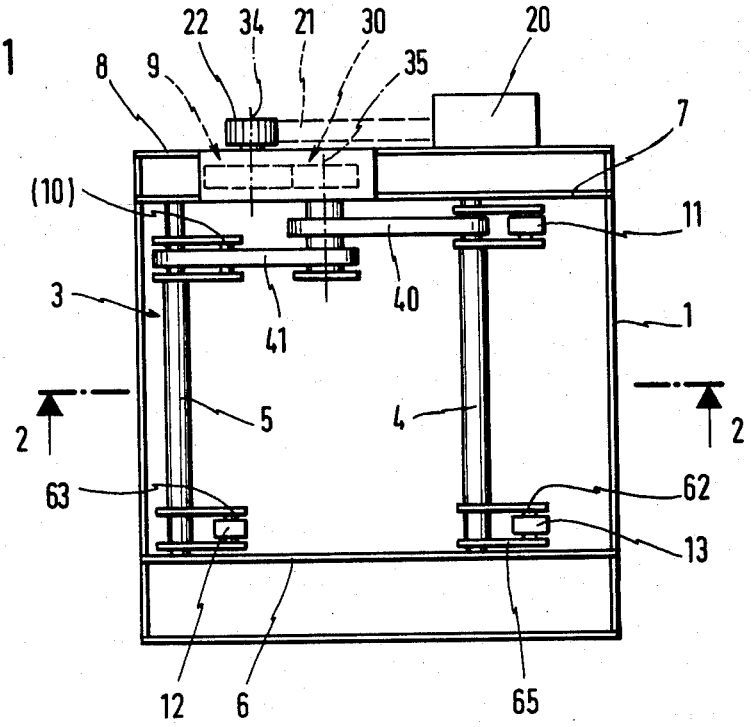

DEVICE FOR PUNCHING FLAT SHAPED ARTICLES, PARTICULARLY PAPER, PAPERBOARD OR THE LIKE

The invention relates to a device for punching flat shaped articles, particularly paper, paperboard or the like, said device comprising a punching tool consisting of two separate parts, an electromotor, a driving mechanism and a gearing.

There are known various embodiments of punching devices which e.g. are used for paper and by means of which it is possible to carry out the punching in several positions; such punching devices are stationary and include each, either at their upper part or at their lower part, the driving mechanism, the gearing and for example an electromotor. These stationary punching devices can only be mounted in horizontal or vertical position. If a part of these punching devices has become unusable, the whole device has to be exchanged; neither is it possible to use individual parts of these punching devices in a desired position, either e.g. as lower frame or upper frame.

This invention is based on the problem to provide a device for punching flat shaped articles of the initially mentioned type which can be used universally. According to the invention this problem is solved by combining the electromotor, the gearing, the driving mechanism and one part of the punching tool to form a separately transportable constructional unit.

This constructional unit can—if only the second part of the punching device is correspondingly mounted or provided—be used as upper part or as lower part; it is even without more ado possible, by using this constructional unit, to punch in horizontal direction.

According to a preferred embodiment of the invention, the constructional unit is mounted in or at a frame; the frame can be provided with a bottom which has throughholes for the transmission rods of the driving mechanism. The constructional unit has a relatively low height when it is correspondingly constructed, and it can under simple mounting conditions without more ado be optionally inserted, provided that—of course—a corresponding second part of the punching tool is provided. That is, this constructional unit can also be inserted in running transport systems of the material to be punched, for example in a transport system for paper, corresponding paperboard or even plastic foils supplied in imbricated form. The insertion in such a system requires only a relatively low additional expenditure of mounting. The driving mechanism includes preferably at least one toggle-lever rod, whereby the transmission of the power from the electromotor is substantially simplified and an especially compact construction is achieved.

If, for example, there is provided a rectangular or an approximately rectangular punching tool to be used, for example, for all around trimming of sheet stacks or of paper supplied in the form of embricated layers, the one part of the punching tool is usefully held at its four corners by rods extending vertically to the frame plane.

It can be useful that for increasing the punching speeds the driving mechanism is operated with a differing transmission ratio. The invention suggests that for this purpose the gearing either includes two gears having an elliptic or basket-arch-shaped cross-section, each gear being eccentrically mounted, or includes one gear having a circular cross-section and one gear having a noncircular cross-section and being eccentrically mounted, and the driving mechanism at a plate having a rotatable cam is eccentrically mounted.

The electromotor practically includes an adjusting mechanism for regulating the speed and a brake, whereby it is made possible to control the absolute speed of the punching operation. If, however, the gearing driven further up is used, the transmission ratio is periodically changed, with the relation between the different speeds remaining at an equal ratio.

The electromotor can have a connection for a transport device for the material to be punched so that the transport and the punching operation can be carried out synchronously.

As a result of the compact construction of the inventive constructional unit and the relatively small inertia masses, it is possible to increase the speed of the punching operation so as to exceed the known usual speeds of e.g. 240 punching operations per minute, the number of revolutions of the electromotor being at least 300 r.p.m.

It is particularly in case of the above mentioned example of a rectangular or approximately rectangular shape of the punching device that preferably the rods are linked in pairs, one pair to one shaft which is mounted in the frame.

The shafts when in their neutral position and the articulated mounting of the rods can be arranged at the same level. This means practically that these two mountings are provided in the plane of the frame.

It is furthermore possible that the rods are extending in the bottom.

Figure 2:
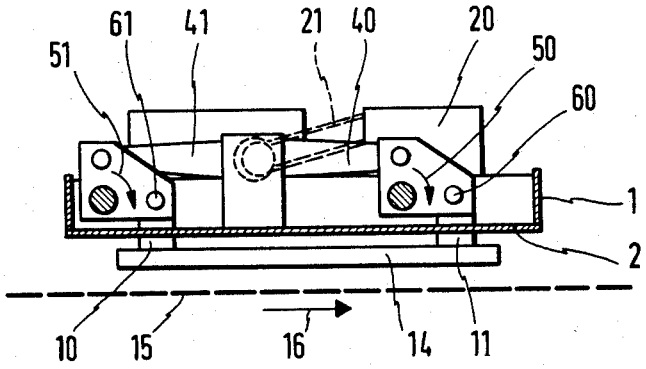

The drawing shows a schematic representation of an exemplifying embodiment of the invention which hereinafter is described in more detail; it is shown in FIG. 1 a top view on the exemplifying embodiment, FIG. 2 a section along the line 2—2 in FIG. 1, and FIG. 3 a detail of the gearing in strongly schematisized manner of representation.

An approximately square frame 1 having an overall height of about 15 to 20 cm contains a bottom 2 and includes the driving mechanism 3 which consists of two shafts 4, 5 arranged parallel to each other, each being mounted in plates 6, 7 extending parallel to one side of the frame 1. A gearing 9 is provided between the plate 7 and the frame side 8.

The bottom 2 is provided with through-holes for four rods 10,11,12,13 extending in the bottom and supporting one part of the punching tool 14. The broken line 15 indicates a conveyor belt which in this case extends horizontally beneath the part 14 and which is intermittently advanced in the direction of the arrow 16. Beneath the conveyour belt, there is mounted the second part of the punching tool which is not shown. The lower part including this part of the punching tool is not subject matter of the invention.

As already mentioned above, the device combined in the frame 1 as a constructional unit cannot only be used—as explained above—as an upper part of a punching device but also as a lower part and even, for the purpose of horizontal punching, in vertical arrangement.

An electromotor 20 arranged laterally of or above the frame is connected to a gear 22 via a conveyor belt 21. The conveyor belt can be made of a synthetic material and can be provided with an internal toothing. The electromotor 20 can be provided with a further driving facility which relates to the advance movement of the material to be punched. Same proves to be practical particularly in those cases in which value is set on an especially great accuracy in the synchronization of punching and transport, and punching is to be executed particularly rapidly.

The minimum speed of the electromotor is 300 r.p.m., it is provided with a possibility to control the speed and can include a brake.

Figure 3:
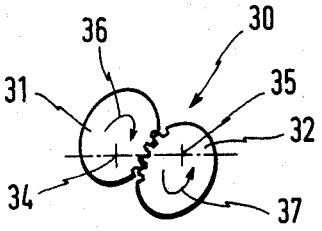

The gear 22 drives an ellipse-shaped wheel gear 30 which is shown strongly schematisized in FIG. 3. The two gears 31 and 32 having an elliptic cross-section each are rotatably mounted about axes 34 and 35 and rotate in the direction of the arrow 36 and 37, respectively. The eccentric mounting of the elliptic wheel pair makes possible differing speeds of the driving mechanism during punching, whereby the punching time as a whole is shortened so that it is possible to achieve by means of the constructional unit up to 300 and more punching operations per minute.

In order to reduce the inertia masses in the driving mechanism, there is connected to the axis 35 an eccentric cam transmission which consists of two plates 40 and 41 each having eccentrically mounted cams (not shown) which in dependence on the drive at different transmission ratios effect an up and down movement of the punching device in the direction of the arrow 50, 51, the plates 40 and 41 causing a transmission of the rotational movement into an up and down movement of the rods 10 through 13. This up and down movement is achieved by the respective rotation about the shafts 4 and 5, the up and down movement being performed at periodically changing speeds, as has already been mentioned.

The rods 10 and 11 are connected to the plate pairs, e.g. 65, by means of joints 60 and 61 or 62 and 63, and follow the movements of the toggle lever.

Instead of the elliptic wheel gear, there can be used e.g. either two gears having a basket-arch-shaped cross-section or a gear having a circular cross-section and a gear having a noncircular cross-section and being eccentrically mounted.

I claim:

1. A device for punching flat articles or the like, comprising a rectangular frame having a drive motor attached thereto; a rotatable shaft attached to and extending toward the interior of said frame; means for rotatably coupling said drive motor to said rotatable shaft; a pair of crank arms eccentrically mounted to said rotatable shaft, each of said crank arms having a distal end; a pair of parallel rocker shafts attached to said frame and each rocker shaft passing through the interior of said frame; a toggle lever rocker arm pivotally mounted to each rocker shaft along a first axis through said toggle lever, and pivotally attached to a distal end of a crank arm along a second axis through said toggle lever; and a punching tool pivotally coupled to said toggle lever along a third axis through said toggle lever; whereby said drive motor causes pivotal movement of said toggle levers about said rocker shafts and corresponding reciprocating movement of said punching tool about said rocker shafts.

2. The device of claim 1, further comprising a transmission rod pivotally coupled between said punching tool and each of said toggle lever third axis couplings.

3. The device of claim 2, wherein said punching tool is positioned outside the interior of said frame.

4. The device of claim 1, wherein said means for rotatably coupling said drive motor to said rotatable shaft further comprises a first and second elliptical gear, each gear respectively eccentrically coupled about a shaft.

5. The device of claim 1, further comprising a further toggle lever rocker arm coupled to each toggle lever rocker arm to pivot in coincidence therewith about said rocker shaft.

6. The device of claim 5, further comprising a transmission rod pivotally coupled between each of said toggle lever rocker arms and said further toggle lever rocker arms to said punching tool.

7. The device of claim 6, wherein said transmission rods extend beyond the interior of said frame.

8. The device of claim 7, wherein said punching tool is positioned outside the interior of said frame.

9. The device of claim 8, wherein said means for rotatably coupling said drive motor to said rotatable shaft further comprises a first and second elliptical gear, each gear respectively eccentrically coupled about a shaft.

* * * * *